US010118088B2

(12) United States Patent
Guarnieri

(10) Patent No.: US 10,118,088 B2
(45) Date of Patent: Nov. 6, 2018

(54) PINBALL MACHINE AND REDEMPTION SYSTEM

(71) Applicant: JJ PINBALL LLC, Lakewood, NJ (US)

(72) Inventor: Jack Guarnieri, Jackson, NJ (US)

(73) Assignee: JJ PINBALL LLC, Lakewood, NJ (US)

( * ) Notice: Subject to any disclaimer, the term of this patent is extended or adjusted under 35 U.S.C. 154(b) by 0 days.

(21) Appl. No.: 14/819,642

(22) Filed: Aug. 6, 2015

(65) Prior Publication Data

US 2015/0335994 A1 Nov. 26, 2015

Related U.S. Application Data

(63) Continuation of application No. 13/672,272, filed on Nov. 8, 2012, now Pat. No. 9,132,341.

(60) Provisional application No. 61/557,089, filed on Nov. 8, 2011.

(51) Int. Cl.

| | |
|---|---|
| ***A63F 7/30*** | (2006.01) |
| ***A63F 7/02*** | (2006.01) |
| ***G07F 17/32*** | (2006.01) |
| ***G07F 17/38*** | (2006.01) |

(52) U.S. Cl.

CPC ..... *A63F 7/30* (2013.01); *A63F 7/027* (2013.01); *G07F 17/3248* (2013.01); *G07F 17/38* (2013.01); *A63F 2250/146* (2013.01)

(58) Field of Classification Search

USPC ..... 273/118 R, 118 A, 119 R, 119 A, 121 R, 273/121 A, 121.13, 123 R, 123 A, 127 R, 273/108

See application file for complete search history.

(56) References Cited

U.S. PATENT DOCUMENTS

| | | | | |
|---|---|---|---|---|
| 2,012,502 A * | 8/1935 | Fey | A63F 7/027 | 273/121 A |
| 3,275,324 A | 9/1966 | Burnside | | |
| 4,375,286 A * | 3/1983 | Seitz | A63F 7/027 | 273/121 A |
| 4,893,821 A | 1/1990 | deOrbegoso et al. | | |
| 5,120,060 A * | 6/1992 | Parker | A63F 7/022 | 273/120 A |
| 5,149,093 A * | 9/1992 | Schilling | G07F 17/32 | 273/118 A |
| 5,342,049 A | 8/1994 | Wichinsky et al. | | |
| 5,667,217 A | 9/1997 | Kelly et al. | | |

(Continued)

*Primary Examiner* — Nini Legesse

(74) *Attorney, Agent, or Firm* — Myers Wolin, LLC

(57) ABSTRACT

In one embodiment there is provided a pinball game comprising a play field having a plurality of different achievable objects, a plurality of different reward cards, each reward card associated with one of the achievable objects and capable of being dispensed by a card dispenser in response to the achieving of its associated achievable object, and wherein at least one reward card is dispensed by the card dispenser during or after game play upon at least one of the achievable objects being achieved, and wherein a different reward card is dispensed depending on the achievable object that is achieved. In one embodiment, a networked redemption system is associated with the game and the game further enables connectivity with social media and/or other publishing avenues for communicating information about the player and/or game play.

18 Claims, 10 Drawing Sheets

(56) References Cited

U.S. PATENT DOCUMENTS

| | | | | |
|---|---|---|---|---|
| 5,697,611 | A * | 12/1997 | Kelly | A63F 7/02 273/126 A |
| 6,015,344 | A * | 1/2000 | Kelly | A63F 3/081 463/16 |
| 6,036,189 | A * | 3/2000 | Gomez | A63F 7/027 273/118 A |
| 6,390,470 | B1 * | 5/2002 | Huang | A63F 1/00 273/118 A |
| 6,641,136 | B2 * | 11/2003 | Huang | A63F 1/00 273/118 A |
| 8,052,518 | B1 * | 11/2011 | Kelly | A63F 3/081 463/16 |
| 9,132,341 | B2 * | 9/2015 | Guarnieri | A63F 7/30 |
| 2001/0009316 | A1 * | 7/2001 | Krise | A63F 7/022 273/108 |
| 2008/0176660 | A1 * | 7/2008 | Kelly | G07F 17/32 463/42 |
| 2009/0131158 | A1 * | 5/2009 | Brunet De Courssou | G07F 17/32 463/26 |
| 2010/0029367 | A1 * | 2/2010 | Englman | G07F 17/3276 463/20 |
| 2013/0147111 | A1 * | 6/2013 | Popadiuk | A63F 7/027 273/118 A |

* cited by examiner

PINBALL MACHINE AND REDEMPTION SYSTEM

CROSS-REFERENCE TO RELATED APPLICATIONS

This application is a continuation of U.S. patent application Ser. No. 13/672,272, filed Nov. 8, 2012, which claims the benefit of U.S. Application 61/557,089, filed Nov. 8, 2011, the contents of each of which are incorporated by reference herein.

FIELD OF THE INVENTION

The present invention relates to pinball games generally, and more particularly to a redemption system for a pinball game.

BACKGROUND

The pinball machine experience hasn't changed too much throughout the years other than improvements in sound, graphics and structural playfield features. The return on a player investment is usually a temporary escape within the game play and a score that is compared with other scores from the same player and/or other players of the game. Furthermore, a player's interaction with a pinball machine is usually limited to the insertion of money to initiate play and the resultant game play. There is typically little or no physical takeaway from the game play. There is a need, therefore, for a pinball machine experience that transcends the experience of the past.

SUMMARY

In one embodiment there is provided a pinball game comprising a play field having a plurality of different achievable objects, a plurality of different reward cards, each reward card associated with one of the achievable objects and capable of being dispensed by a card dispenser in response to the achieving of its associated achievable object, and wherein at least one reward card is dispensed by the card dispenser during or after game play upon at least one of the achievable objects being achieved, and wherein a different reward card is dispensed depending on the achievable object that is achieved. In one embodiment, a networked redemption system is associated with the game and the game further enables connectivity with social media and/or other publishing avenues for communicating information about the player and/or game play.

DETAILED DESCRIPTION OF THE PREFERRED EMBODIMENTS

Figure 1:
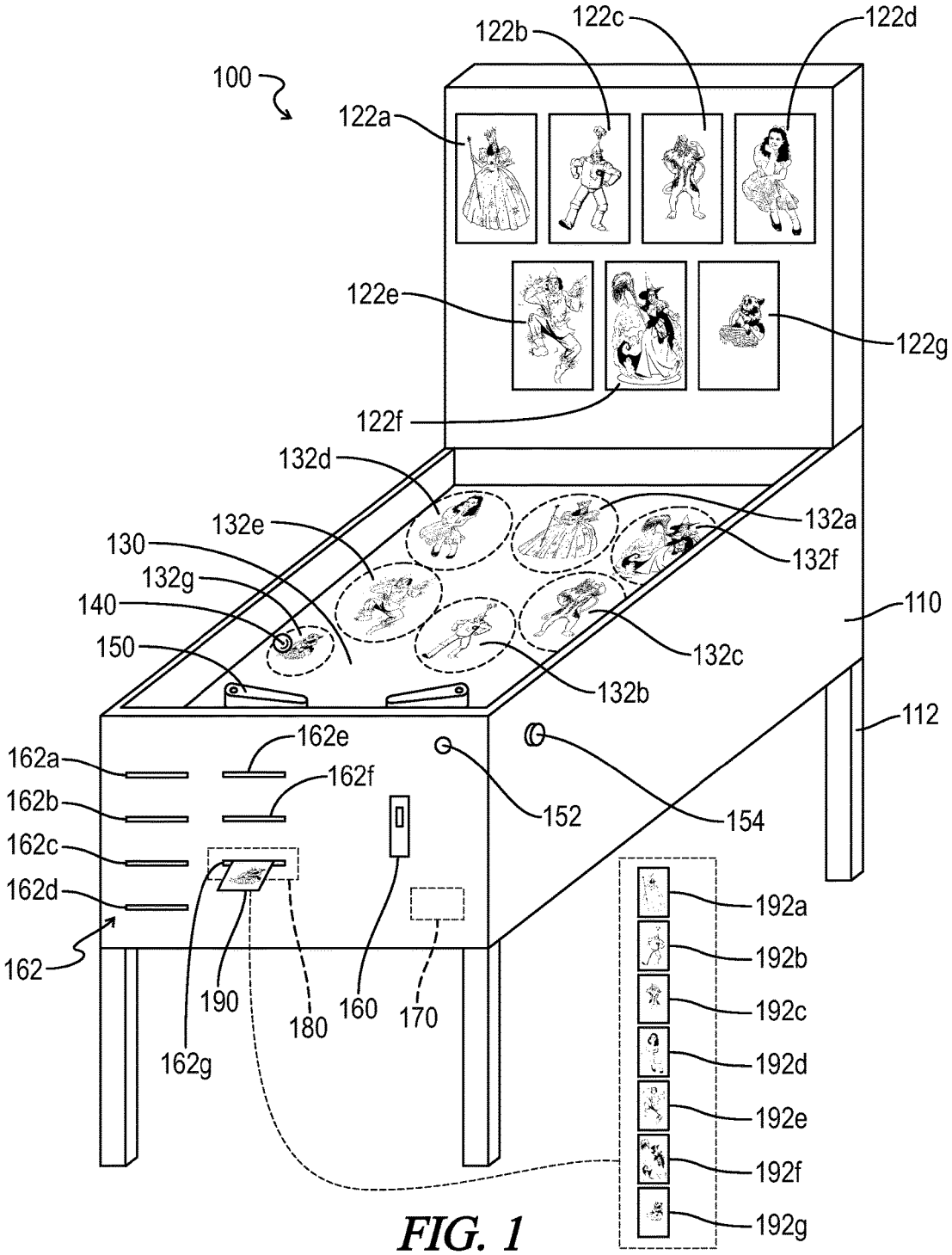
FIG. 1 illustrates one embodiment of a pinball game incorporating aspects of the invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 illustrates one embodiment of an arcade game 100, which is illustrated herein for purposes of explanation as a standalone pinball game 100, it being understood that other types of games are possible. Traditional pinball games, for example, operate using a steel ball and flippers that implicate a sensory experience that is visual, aural and tactile. Some games simulate these experiences in a purely digital or electronic environment, where the game may be incorporated in a structural housing or chassis, yet the internals and displays are mostly electronic. These types of games might be seen in areas that cannot accommodate the traditional footprint of an old style pinball machine, such as in bars, restaurants, rest stops and the like, and may utilize housings that are more vertical nature, or that are incorporated into tabletop units, or the like, and are thus akin to simulated pinball games in a "video game" environment. In addition, some games might be played on game consoles in a home or commercial setting, or on mobile devices anywhere, where the game play occurs independent of others or as part of a networked community of players. Thus, while one embodiment of the game 100 is illustrated and described as a pinball machine, it should not be understood in a limiting sense, with other games being possible.

Returning to the embodiment of FIG. 1, game 100 further comprises a cabinet 110 situated on one or more legs 112, an upwardly extending display 120 arranged toward the rear of the cabinet 110 for displaying a variety of player- and game-related information, a playing field 130 that accommodates one or balls 140 and having a variety of different regions of play 132, ball controllers and/or flippers 150 accessed by input devices or buttons 152 and 154 where button 152 might be used to launch a ball 140 into the field 130 and buttons 154 might be used to maintain the ball 140 on the field 130, an input 160 adapted to receive some form of payment or other means for initiating or starting the game 100, a processor 170 for operating the game 100, and a dispenser 180 controlled by the processor 170 for dispensing one or more prizes 190 through one or more output locations 162. In the game 100 of the embodiment of FIG. 1, various regions 132 on the field 130 might be associated with certain achievable objects, such as the hitting of a target, or a plurality of targets, or the seating of the ball in a particular recess, or the opening or closing of a game feature, or the directing of the ball onto a ramp, and so on.

In addition, each region 132 may also be associated with a particular feature related to the theme of the game 100, where in the illustrated embodiment such theme might be the movie The Wizard of Oz (trademark), and each region 132 might be related to one of the characters or features in the movie such as, but not limited to the Good Witch 132*a*, the Tin Man 132*b*, the Lion 132*c*, Dorothy 132*d*, the Scarecrow 132*e*, the Wicked Witch 132*f*, and Toto 132*g*, that are similarly depicted on the display 120 with associated images 122*a*-122*g* related to such regions 132*a*-132*g*, for example. A player achieving an object in one of the regions 132, such as the region 132*d* associated with the Dorothy character, might cause a similar indication 122*d* to appear on the display 120, thereby reinforcing to the player that an object in the Dorothy-related region 132*d* has been achieved.

The achieving of an object in a particular region 132 might also result in the dispensing of a reward to the player at the time the object is achieved or at the conclusion of play or during a combination of different times established by the game developer. In the illustrated embodiment of FIG. 1, one or more reward cards 192*a*-192*g*, each preferably associated with one of the regions 132*a*-132*g*, might be dispensed by the dispenser 180 through the one or more locations 162 upon the player achieving the object associated with such region or regions. A chute or a container may be associated with the dispenser location 162 to catch the one or more reward cards dispensed therefrom. While a game-specific reward card is shown, it will be appreciated that generic, non-game-specific reward cards may be dispensed if desired. Also, while a reward in the form a card is shown and described, it will be appreciated that other reward types may be used, such as physical tickets, coins, tokens, toys, plush animals, or the like, and/or the rewards may not necessarily be physical where the reward might be the transmission of an electronic certificate, a digital coupon, the addition of value to a redemption card or a redemption account associated with the player, etc., as will be described below. For purposes of illustration, however, a reward card will be described.

For a single player game, there might only be provided one set of cards that are dispensed through a single outlet by a single dispenser. For a multiple player game, for example, there might be provided a different set of cards for each player, with each set being dispensed by a different dispenser, with a different dispenser outlet for each player's card dispensed by each player's affiliated dispenser. The cards may be dispensed during and/or after game play. In addition, in certain situations, it may be necessary to dispense a card at the end of every game play as a token reward even if the player did not achieve a single achievable object, in order to ensure legal operation in certain jurisdictions as well as to reward and encourage the player to play again.

The reward cards are preferably provided with a consistent and coordinating image of the region and/or character to reinforce the achievement of the particular object, so that, for example, a player achieving an object the region 132*d* associated with the Dorothy character might cause a similar indication 122*d* to appear on the display 120 and might cause a Dorothy-imaged card 192*d* to be dispensed, under the control of the processor 170, by the dispenser 180 to the player through the output location 162. While in the embodiment of FIG. 1 there are provided output locations 162*a*-162*f*, one for each type of card 192*a*-192*f*, it is also possible to only use a single output location that can accommodate and dispense different types of cards dispensed by the dispenser 180. In one embodiment, a single player might play a game that only includes a single ball 140, whereby it might be difficult to achieve multiple achievable objects that would result in the dispensing of multiple reward cards. During this type of game setting, game rules might be provide that enable a skillful player to extend play by achieving free balls, multi-balls or the like, which would lengthen game play.

Figure 2A:
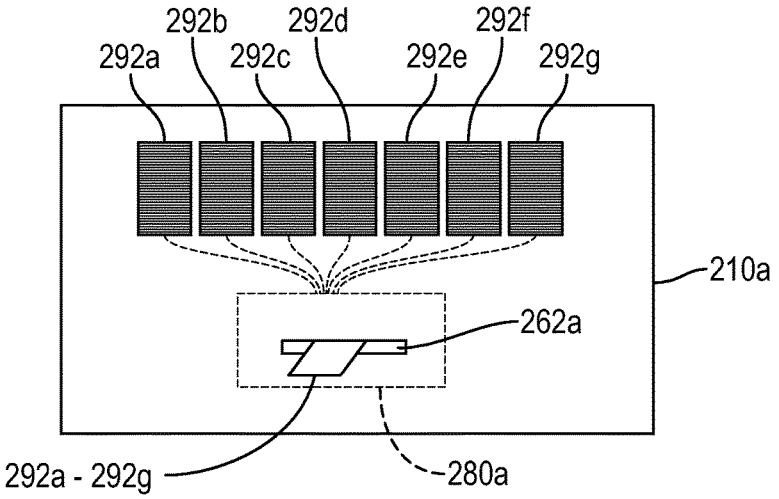
FIG. 2A illustrates one embodiment of a portion of a game cabinet incorporating reward cards
Figure 2B:
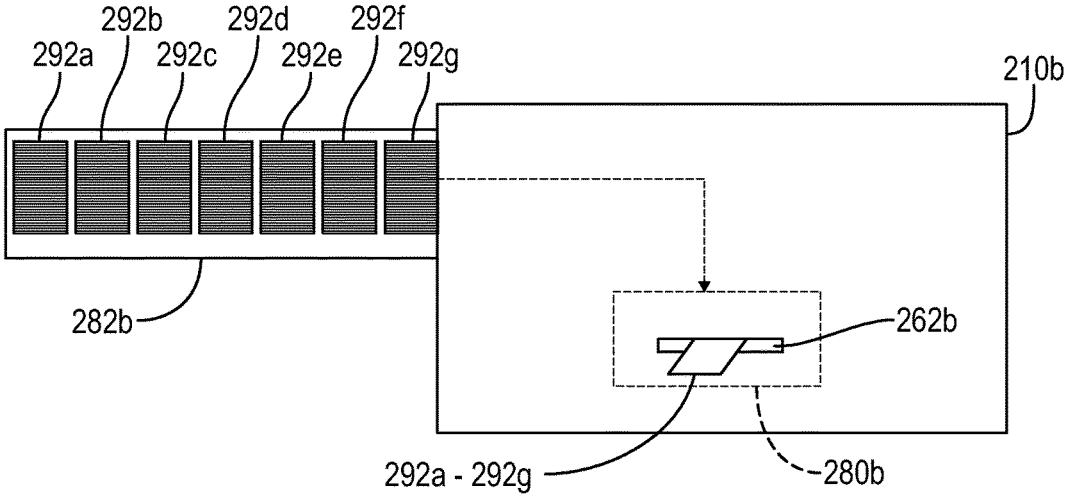
FIG. 2B illustrates one embodiment of a portion of a game cabinet with an attached card dispenser.
Figure 2C:
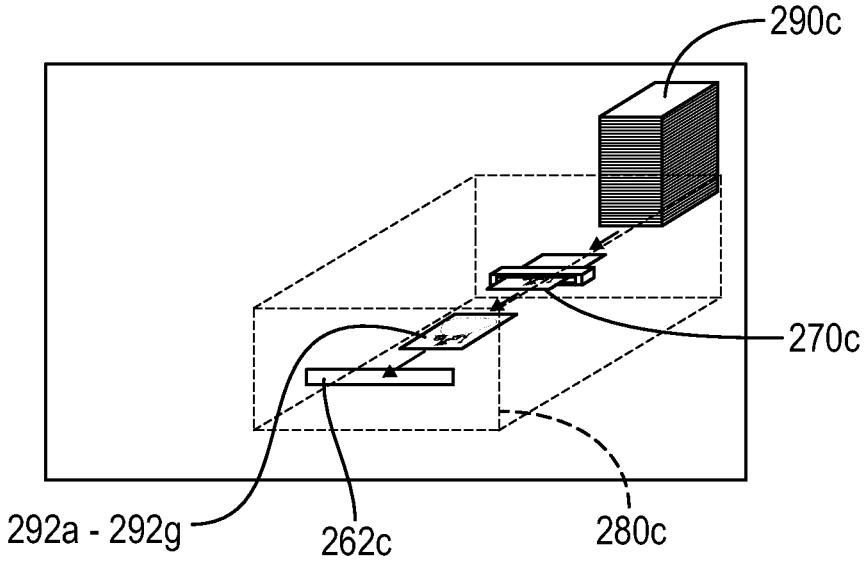
FIG. 2C illustrates one embodiment of a portion of a game cabinet including a card dispenser.
Figure 2D:
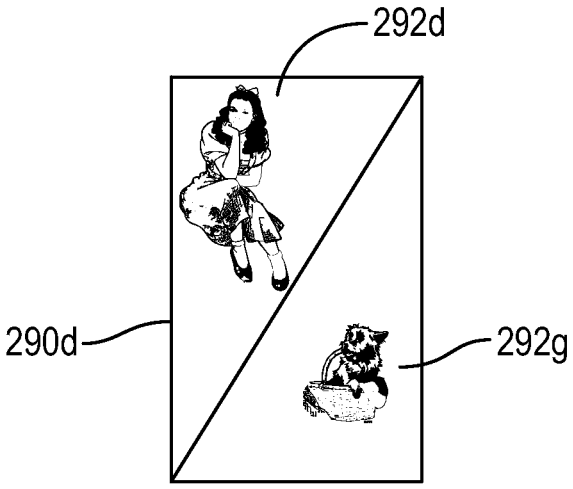
FIG. 2D illustrates one embodiment of a reward card.

FIG. 2A illustrates one embodiment of a card dispenser 280*a* that dispenses one or more reward cards 292*a*-292*g* through a single dispensing location 262*a*, where the cards are arranged in decks that are internally stored in the cabinet 210*a*. FIG. 2B illustrates one embodiment of a card dispenser 280*b* that dispenses one or more reward cards 292*a*-292*g* through a single dispensing location 262*b*, where the cards are arranged in decks that are stored in a separate location 282*b* external of the cabinet 210*b*. Having the reward cards stored in an external location is helpful for replenishing the cards without having to access the inside of the cabinet 210*b* and/or disrupting a player during game play. The card storage locations are preferably provided with sensors (not shown) or the like that indicate when it is nearing time to replenish the one or more types of cards, which sensors preferably communicate with personnel in the area tasked with replenishing the cards. The storage locations could also be networked to a communication system that similarly alerts personnel at the appropriate time at the game location or via a remote location that manages the game systems and issues the appropriate communications to nearby personnel. FIG. 2C illustrates yet another embodiment of a card dispenser 280*c* that dispenses one or more reward cards 292*a*-292*g* through a single dispensing location 262*c*, where the cards 290*c* are originally blank or without any correlation to the various regions 132*a*-132*g* of FIG. 1, but are then personalized by a printer 272*c* or the like, preferably under direction by the processor 270*c*, into one of the reward cards 292*a*-292*g* prior to or during dispensing by the dispenser 280*c*, where such printer 272*c* is either separate from or incorporated into the body of the dispenser 280*c*, such that the dispenser 280*c* dispenses personalizes reward cards to the player. While the personalization of the reward cards has been described through the action of printing, it will be appreciated that any technology now known or hereinafter developed could be used to transform a blank card into a personalized card that is reflective of the various regions on the field 130 or otherwise personalized to the player. Furthermore, it will also be appreciated that a card may be provided with more than one type of image, or related to more than one region on the field, such as the card 290*d* of FIG. 2D that shows both an image of Dorothy related to card 292*d* and Toto related to card 292*g*. Other variations are possible.

In one embodiment, the reward cards may have no commercial value and may be kept as souvenirs or the like. In another embodiment, each individual card may be redeemable through a redemption center that is associated with the location in which the game resides. For example, if the game is located in an arcade that is populated with other redemption-type games that dispense tickets or tokens that can be redeemed for prizes, each reward card may be provided with a certain value that would allow it to be redeemed in the same manner as other redemption tokens, tickets, etc., from other games in the same location. The reward cards may each have the same value, or different values depending on, for example, the level of difficulty associated with the achievable object associated with the reward card. For example, returning to the embodiment of FIG. 1, if a player achieves an object associated with region 132*d* that is relatively easy to achieve, that results in the dispensing of a Dorothy card 162*d*, such card 162*d* might be redeemed for one point. However, if a player achieves an object associated with region 132*f* that is very difficult to achieve, perhaps five times more difficult than the region 132*d* associated with the Dorothy card 162*d* for example, that results in the dispensing of an Evil Witch card 162*f*, such card 162*f* might be redeemed for five points. Other variations are possible.

Figure 3:
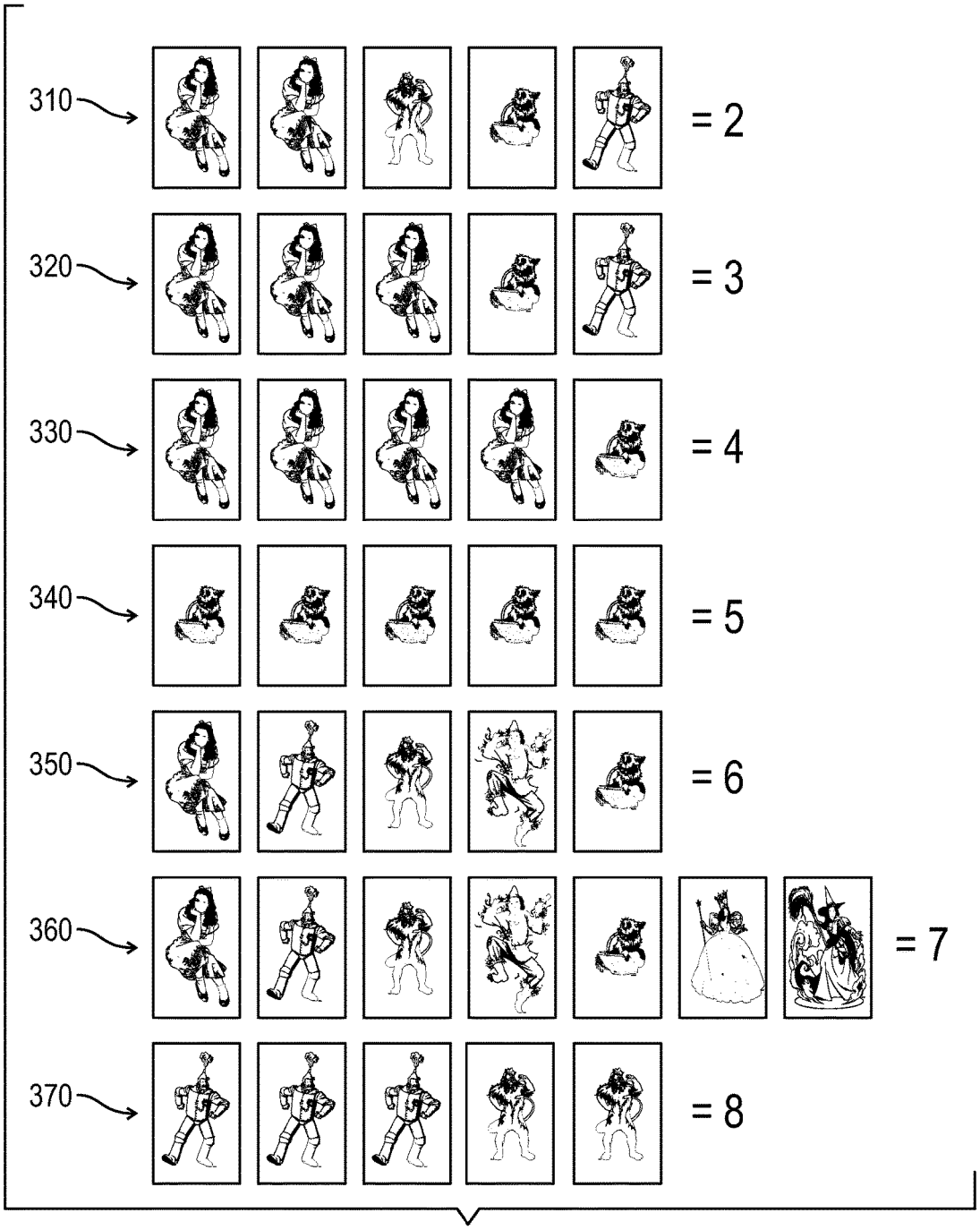
FIG. 3 illustrates one embodiment of a redemption scheme incorporating aspects of the invention.

FIG. 3 illustrates one embodiment of a redemption scheme where reward cards are only redeemable in groups of five cards, similar to a poker hand, where each type of group might have an associated point value. While FIG. 3 illustrates a redemption of a grouping of at least five cards, it will be appreciated that a group formed from any number of cards may be redeemable as desired, where the requirement that a group redemption encourages continued and repeated game play in order to achieve certain groupings of cards. For example: row 310 represents two of a kind that might have a point value of two; row 320 represents three of a kind that might have a point value of three; row 330 represents four of a kind that might have a point value of four; row 340 represents five of a kind that might have a point value of five; row 350 represents the equivalent of a straight in poker that might have a point value of six; row 360 represents a straight of every available kind of card that might have a point value of seven; and row 370 represents the equivalent of a full house in poker that might have a point value of eight. The groupings and point values illustrated in FIG. 3 are not meant to be limiting, but are examples of a redemption scheme that might be utilized at a particular location. In this embodiment, the redemption scheme point values would preferably be located somewhere on or near the game, such as on the display or on the side of the cabinet or on a wall adjacent the game, and near the redemption desk to serve as a guide for a customer service representative.

Figure 4:
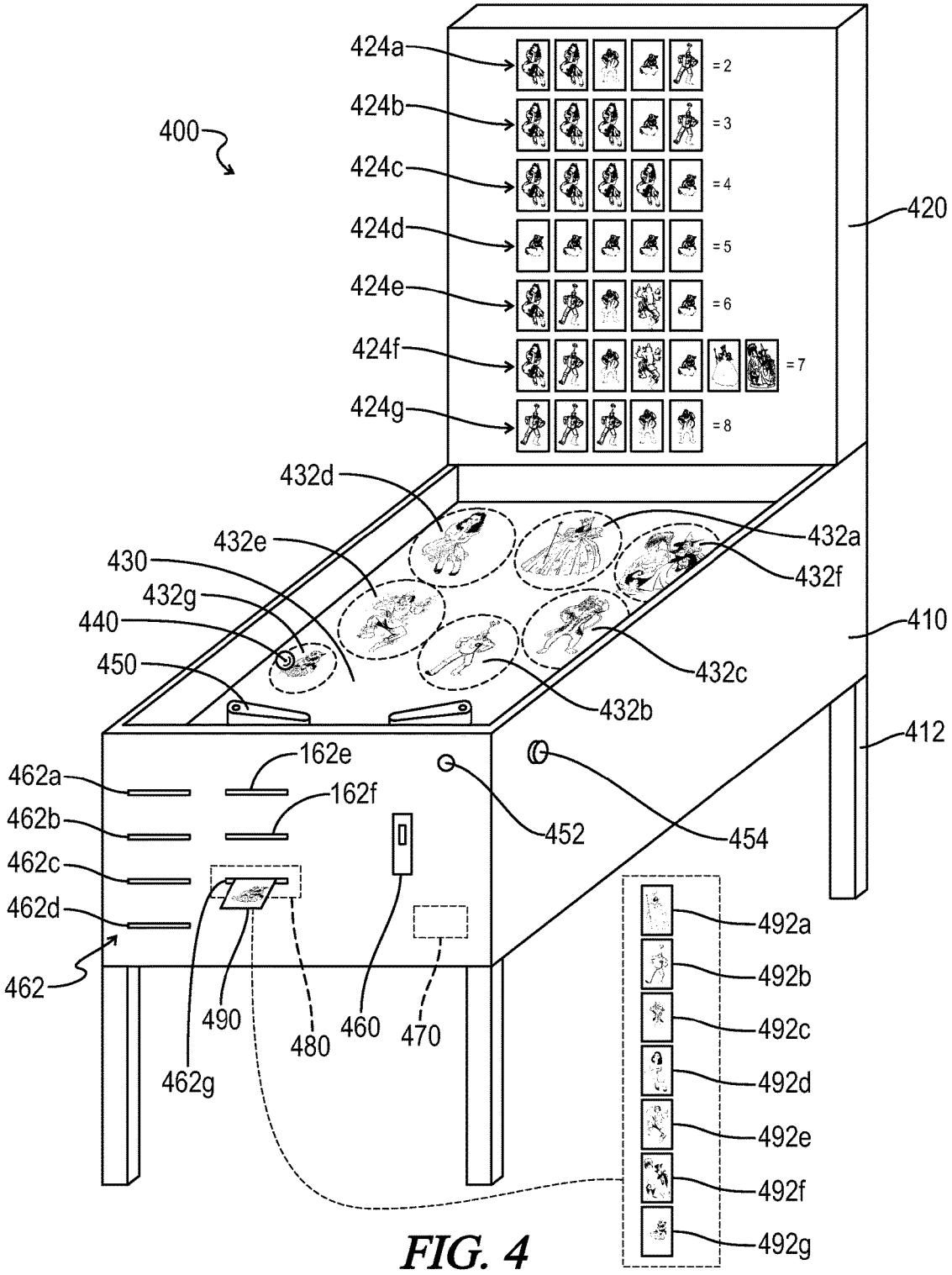
FIG. 4 illustrates one embodiment of a pinball game incorporating aspects of the invention.

FIG. 4 illustrates one embodiment of a game 400 having a cabinet 410, an upwardly extending display 420, a playing field 430 that accommodates one or balls 440 and having a variety of different regions of play 432, ball controllers and/or flippers 450 accessed by input devices or buttons 452 and 454 where button 452 might be used to launch a ball 440 into the field 430 and buttons 454 might be used to maintain the ball 440 on the field 430, an input 460 adapted to receive some form of payment or other means for initiating or starting the game 400, a processor 470 for operating the game 400, and a dispenser 480 controlled by the processor 470 for dispensing one or more prizes 490 through one or more output locations 462. In the game 400 of the embodiment of FIG. 4, various regions 432 on the field 430 might be associated with certain achievable objects as previously described. In addition, the display 420 might be provided with rows 424*a*-424*g* of images of a redemption scheme similar to that of FIG. 3, such that a prize 490 is only awarded if the player achieves a series of achievable objects within a certain period of time, or before the end of the game, or over a number of games if the same player decides to insert more money at the end of the game to continue to try to achieve one of the redemption lines indicated on the display 420. In one example, if a player achieves an object associated with region 432*d*, image 422*d* on each redemption row would illuminate, and this would continue until one of the redemption rows 424*a*-424*g* is completely illuminated, at which time the player would earn a reward associated with the point value of such redemption row. In one embodiment, that redemption row would remain completely illuminated and the player would attempt to illuminate additional rows to earn more points. At the end of the game, a reward card would be dispensed having a total point value that is reflective of the number of redemption rows completed or highlighted on the display 420. Alternatively, a reward card could be dispensed upon completion of a single row, where the reward card has the point value of that row, and afterward the redemption rows reset and the player starts anew.

By requiring a player to amass a certain number of cards, and/or certain types of cards, indicative of the player achieving certain objects during game play, the player is encouraged to both play longer and to attempt to achieve as many different achievable objects that are presented on the play field. This requires that the player fully explore the entirety of the play field, rather than only focusing on one or two easy achievable objects, and master all of the different achievable objects, in order for the player to be presented with an award. To make it more challenging, in one embodiment certain achievable objects may only be achieved by first achieving other objects. For example, in FIG. 1, the achievable object associated region 132*d* may only be revealed upon achieving the object associated with region 132*e*.

In certain environments, the reward cards may be redeemed for points in a conventional manner like you might find at a beachfront boardwalk, where points are accumulated to win prizes of varying point levels. With reference to FIG. 2C, for example, the value of the reward card can be modified or customized depending on the game location where anything can be printed on the reward card. For example, if the game is located in a bar or a restaurant, the reward system might be associated with a complimentary beverage or food item, or the reward card might be printed with a coupon for a certain monetary value that might be redeemed upon dining at such bar or restaurant. Such a redemption scheme encourages and incentivizes patrons to both play the game and enjoy a meal. The reward system might by skill-based, where the value of the dispensed reward is linked to the level of accomplishment in the game. Alternatively, it might be random, where the reward levels vary from relatively minor, like a free drink, to something more substantial like a free meal.

Figure 5A:
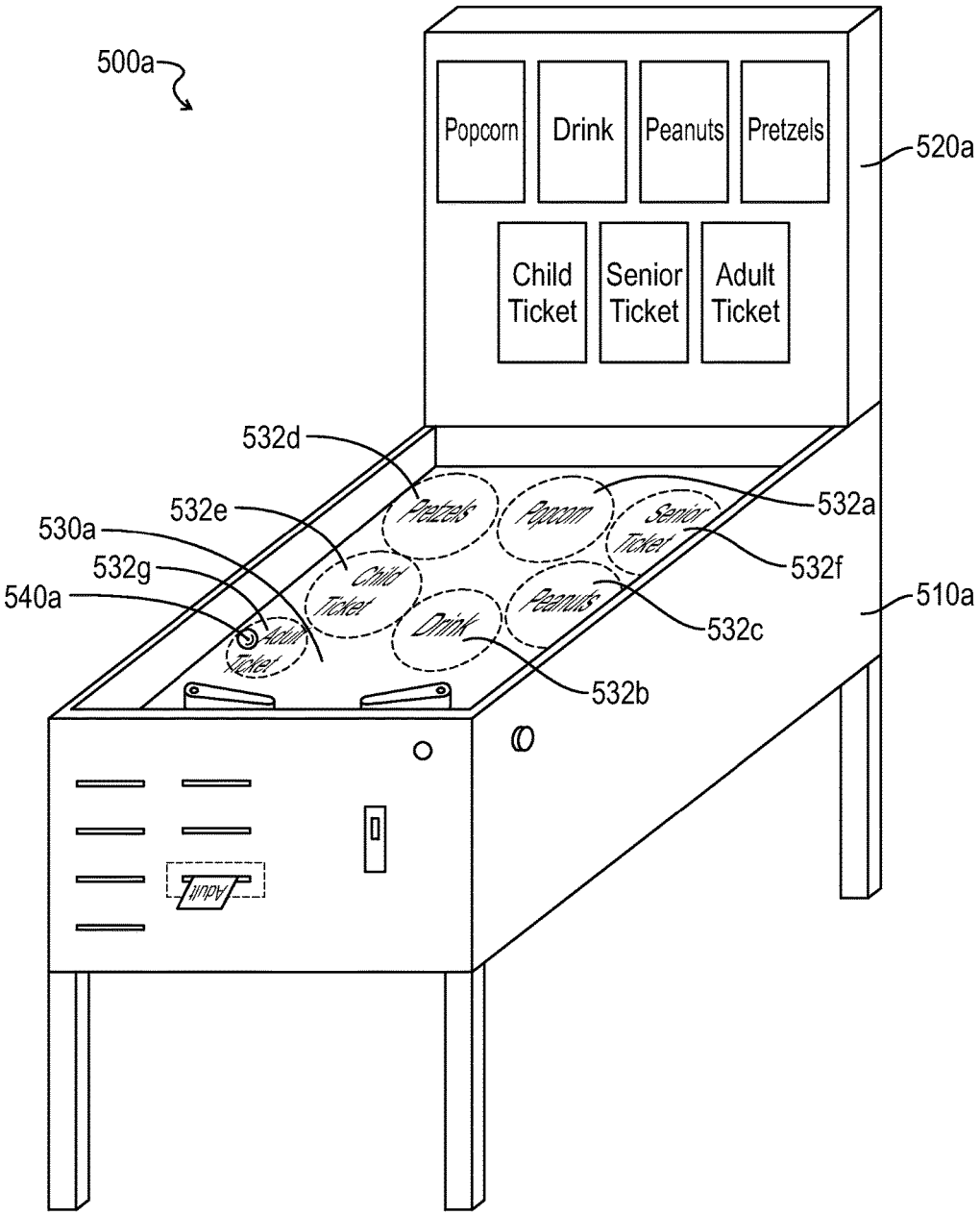
FIGS. 5A and 5B illustrate alternate embodiments of a pinball game incorporating aspects of the invention.
Figure 5B:
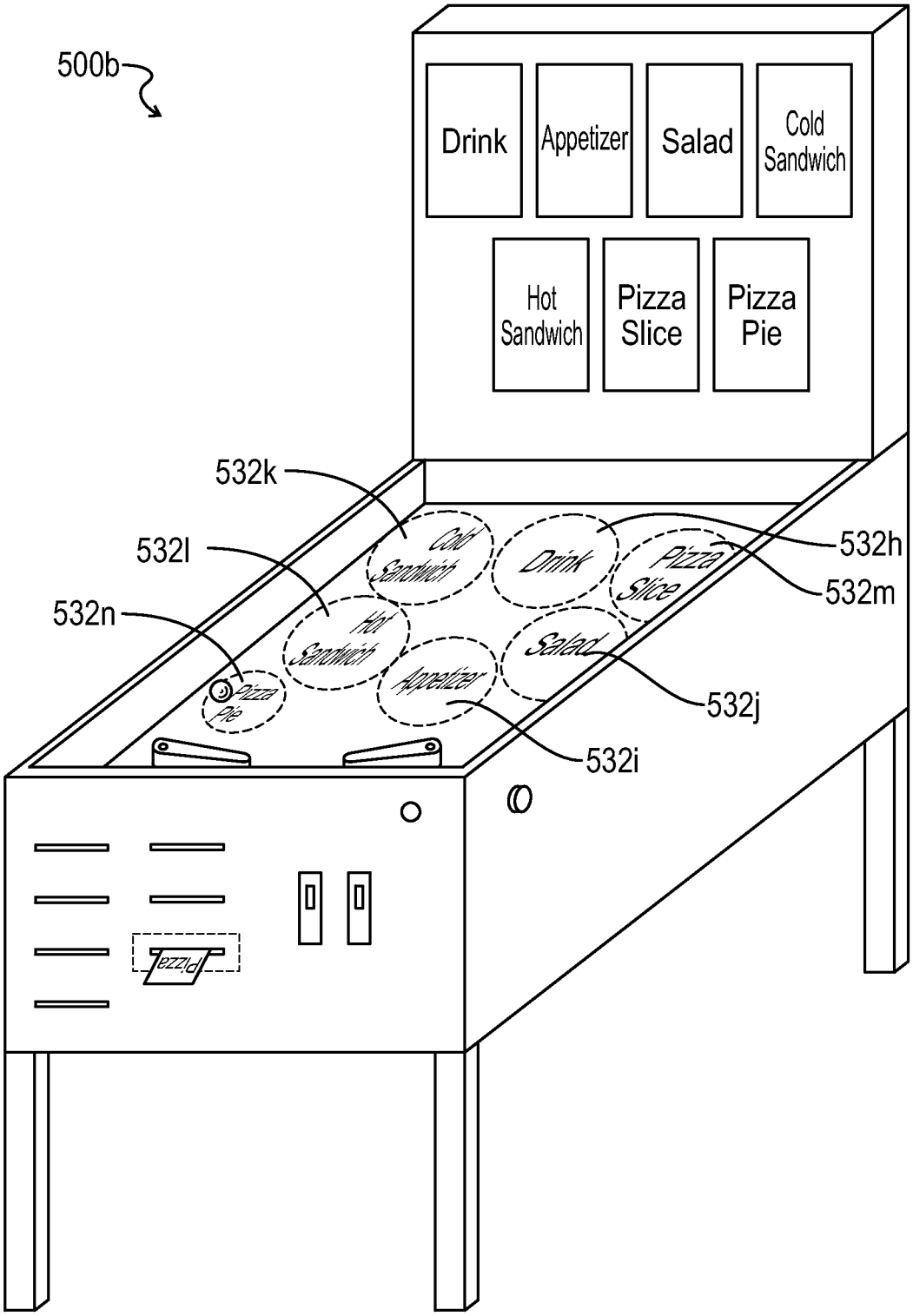

FIG. 5A illustrates one embodiment of a game 500*a* having a cabinet 510*a*, a display 520*a*, a playing field 530*a* that accommodates one or balls 540*a* and having a variety of different regions of play 532, where the various regions 532 on the field 530*a* are associated with certain achievable objects that are related to the venue in which the game 500*a* resides. For example, if the game 500*a* resides in a movie theater, the regions might be defined as follows: popcorn 532*a*, drink 532*b*, peanuts 532*c*, pretzel bites 532*d*, child ticket 532*e*, senior ticket 532*f*, and adult ticket 532*g*, such that the reward card would entitle the player to receive a free item associated with one of the regions 532*a*-532*g*. Similarly, as shown in the embodiment of FIG. 5B, if a game 500*b* resides in a pizza restaurant, the regions might be defined as follows: drink 532*h*, appetizer 532*i*, salad 532*j*, cold sandwich 532*k*, hot sandwich 532*l*, pizza slice 532*m*, and pizza pie 532*n*.

Figure 6:
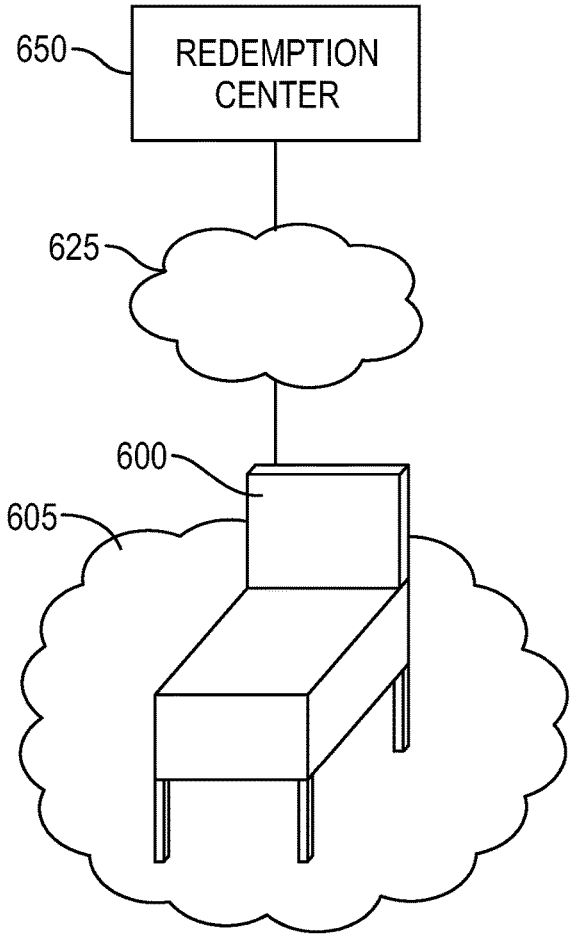
FIGS. 6-9 illustrate various embodiments of a game associated with a redemption center through a network.

In the previously described embodiments, the rewards are redeemable onsite, or at the same location as the game. However, rewards may be redeemable in accordance with a redemption system that is partially or wholly remote from the location in which game resides. FIG. 6 illustrates one example of a game 600 in a physical establishment 605 that is associated with a redemption system 650 through a network 625 that a player can access in a variety of different ways. The network 625 may be a local area network, or a wide area network, or a combination of the same. The redemption system 650 may, for example, be a virtual store that allows players to redeem rewards for actual prizes, such as items that can be delivered to the player through the mail, or for electronic prizes that are redeemable at venues that would accept the same, such as an electronic gift certificate or coupon that is redeemable at a physical location or an online retailer. Users of the redemption system 650 may also accumulate points and redeem the same by accessing a virtual catalog of different prizes similar to the redemption of accumulated airline miles for free travel, lodging or gifts. Users would preferably access the redemption system through a secure connection that requires typical user identification and validation by means of, for example, a username and password. The redemption system 650 may be directly connected to the game 600 through a direct connection to the network 625 via a wired or wireless connection, or it may be separate therefrom.

Figure 7A:
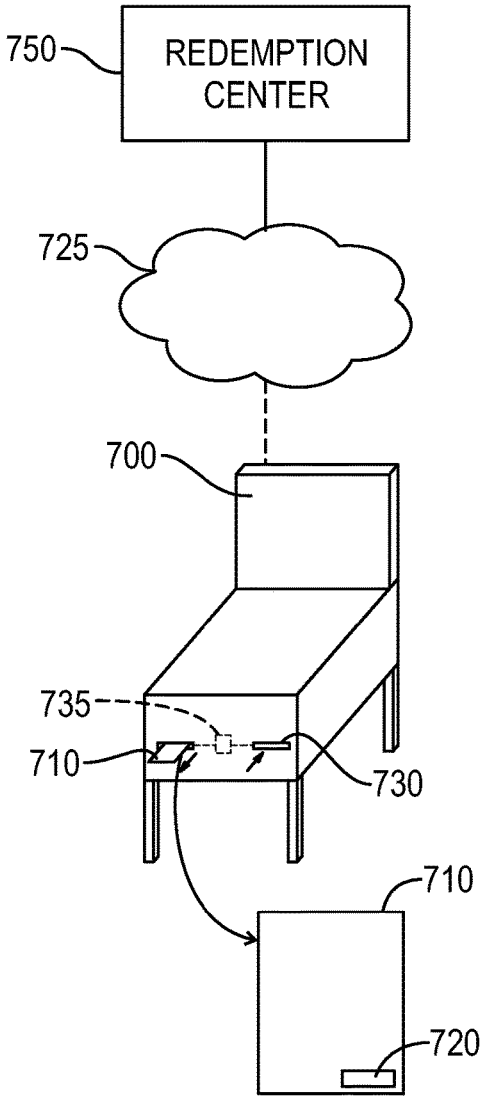

In one embodiment shown in FIG. 7A, a game 700 that is operated in any location, irrespective of whether the location has an onsite redemption counter, is adapted to dispense a reward card 710 having a certain value that is embodied in a unique code 720 printed on the card 710. The reward card 710 is then redeemed at a remote redemption center 750 through an input of the code 720 into the redemption center 750 provided on the card 710. Once the card 710 has been redeemed, the card can be retained as a souvenir or a collector's item, or it can be recycled back into the game 700 through a separate input location 730 that is connected to a recycler 735. In this example, the game 700 is situated in a location that is not directly connected or connectable to the redemption center 750, where the player would receive reward cards 710 having a reward code 720 printed thereon that will be redeemed at a later time. If the player is able to access the redemption center 750 through a mobile device, for example, and the player is able to redeem the reward code 720, thus rendering the reward code unusable by anyone else, then the player may have the option of returning the reward card 710 to the game 700, whereby the recycler 735 may then remove the original reward code 720 and print a new code thereon for redemption by a future player or the same player at a future time. Alternatively, the card dispenser may have a recycling function that removes an old code 720 and a dispensing function that imparts a new code on the card 710. Other methods and approaches are possible.

Figure 7B:
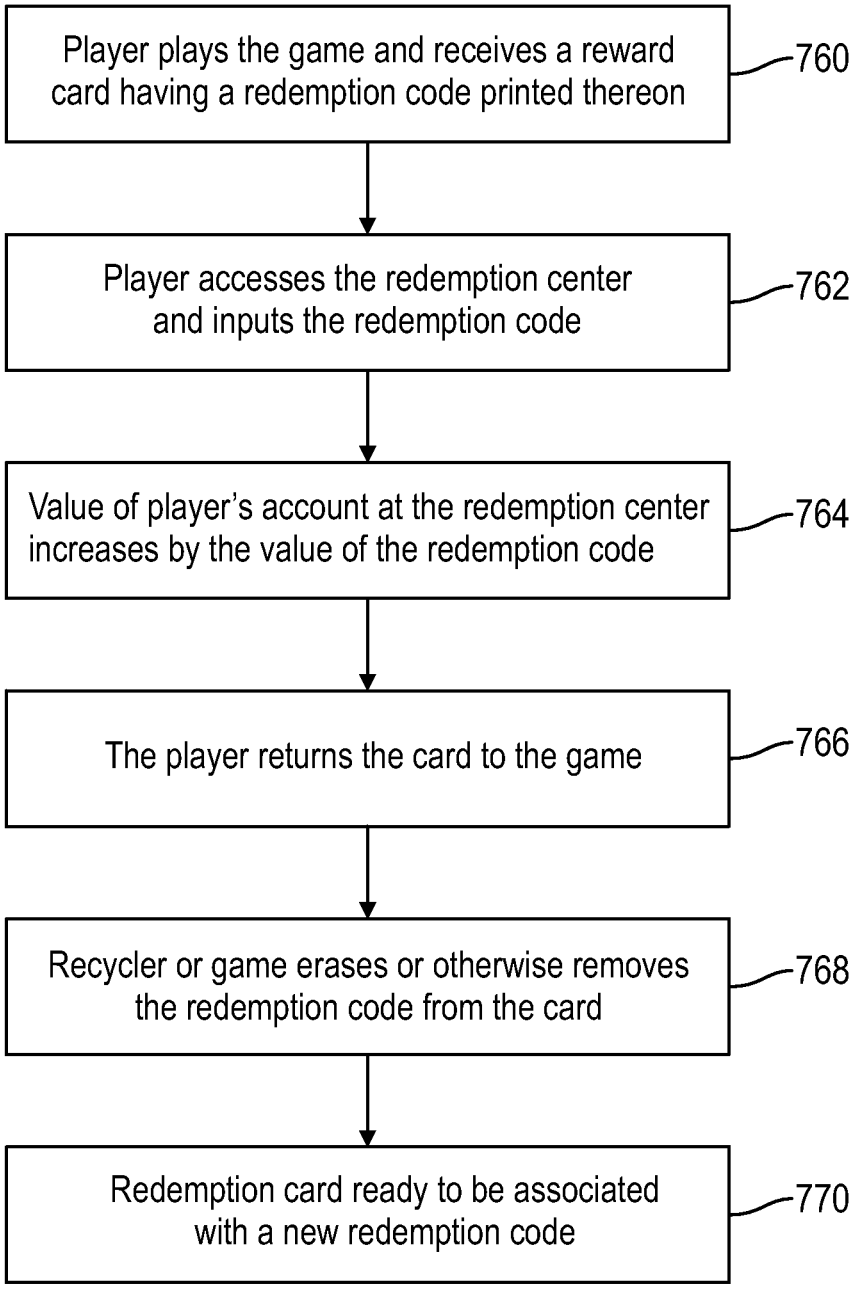

Thus, one redemption scheme illustrated in FIG. 7B might go as follows: a player plays the game and receives a reward card having a redemption code printed thereon, as at 760. Thereafter the player accesses the redemption center and inputs the redemption code, as at 762, which results in the value of player's account at the redemption center increasing by the value of the redemption code, as at 764. Accessing the redemption center and inputting the redemption code can occur at any time after the player receives the redemption code, which might be directly after the player finishes the game if the player is equipped with a mobile device that can access the redemption center. Alternatively, the player can access the redemption center at a later time or date. Thereafter, the player can return the redeemed card to the game, as at 766, whereupon the recycler or game would then erase or otherwise remove the redemption code from the card, as at 768, and the card would be ready to be imprinted with a new redemption code, as at 770. Since, in this embodiment, the game 700 is not directly connected to the redemption center 750, the game may be provided with a database of redemption codes that are associated with certain point values and that can be assigned in sequence or at random and printed on the reward card for redemption at a later time.

This redemption scheme can incentivize players to recycle their reward cards into new reward cards by, for example, being guaranteed to receive a new reward card with a minimum value at the end of the new play. For example, upon the player initiating a new game, the player might be asked by the game if the player has an old reward card to recycle. If the player responds positively and then inserts an old card into a designated location in the game, the player might automatically receive a minimum point value at the start of play that would guarantee that the player will receive a new reward card at the end of play including such minimum point value. Such a minimum point value might be somewhat negligible for purposes of achieving redeemable rewards to discourage players from accruing rewards solely by redeeming used cards. For example, if rewards are redeemed in increments of one hundred points, then a player might receive only one point for recycling an old card.

In the event the game is not directly connected to the redemption center 750, the game might not be able to verify whether the redemption code has already been redeemed, and it is possible that the player may recycle a reward card that has yet to be redeemed. However, this might be desired if, for example, the player does not achieve a meaningful point value after the end of the game and receives a reward card that is effectively worthless, in which case the player might opt to immediately recycle the card without redeeming the points and try again.

Figure 8:
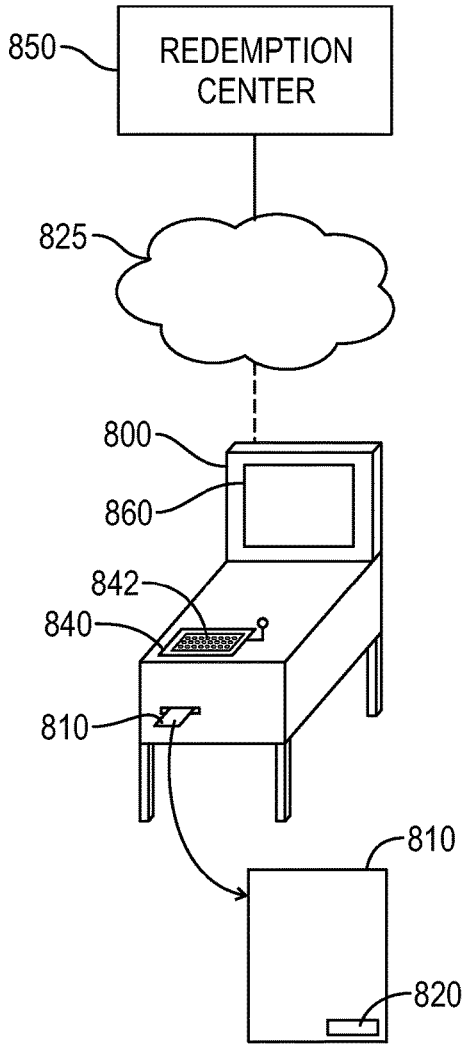

In one embodiment shown in FIG. 8, a game 800 is connected directly via a wired or wireless connection to a redemption center 850 through a network 825 and is adapted to dispense a reward card 810 that may or may not include a unique code 820 printed on the card 810. Because the game 800 is directly connected to the redemption center 850, the player may be presented with an option at the beginning to associate the game play directly with the player's account at the redemption center. In one embodiment, the game 800 is provided with an interface 830 that enables a player to login to the redemption system 850 at the beginning of play. Such interface 840 might include, for example, a keypad 842 that allows a player to type in the player's unique username and password associated with the player's account at the redemption center 850. Alternatively, the interface 830 may include a communication system 844 that enables a player to transmit the player's redemption center credentials from a player's mobile device, for example, to the game 800 and thereon to the redemption center 850, or to the redemption center 850 directly through a player-initiated communication (such as through a mobile device) directly to the redemption center 850 at the start of play. For example, the player may communicate separately with the redemption center 850 by logging into the same from a mobile device, and then the player may enter a unique game identification code located somewhere on the game that then associates and validates the game play with the player's redemption center account, which validation might be communicated to the player by a message on the game 800 that greets the player by name, username or otherwise. Alternatively, the user's mobile device might automatically communicate with the game 810, such as through a wireless or Bluetooth® connection or otherwise, and recognize the unique identification code associated with such game and communicate the same to the redemption center account to validate the player and the player's redemption center account to that particular game, which might all take place upon the player initiating the game by inputting money or the like. Once the game 800 is associated with the player's redemption center account, the player's winnings may be credited directly to the player's redemption center account without the player having to receive reward cards or redeem reward codes as in the examples of FIGS. 7A and 7B. The association between the game 800 and the player's redemption center account would then terminate automatically at the end of the game, or later if the player inserts more money and extends the game, or directly by initiating a disconnect input 860 on the game 800.

The association between a player, the player's redemption center account and the game can result in additional advantages. For example, the player may be able to use the player's redemption center account as a virtual currency, where points may be redeemed for game play, or where the account may be provided with a credit line that is electronically replenished through a credit card or a direct debit from a player's bank account. Therefore, in one embodiment, a player may walk up to a game and press a button that initiates an association sequence that either automatically associates the player's redemption center account with the game, or that enables the player to use an interface on the game to accomplish the same. Once the player's redemption center account is associated with the game and the player has been validated, the player may be presented with several options to initiate play, such as by redeeming account points for game play credit, or by debiting a credit account associated with the player's redemption account, or by inserting money through conventional means (such as through an input location 160 of game 100 of FIG. 1). Other methods are possible. At the end of game play, the player's redemption center account will likely be increased by the player's winnings and the player may receive a notification, such as through electronic mail, of the result of the game play and the current status of the player's redemption center account.

In one embodiment, even though the game 800 is directly connected to the redemption center 850, a first player may wish to receive a reward card 810 that is then given to a second player as a gift, for example, for redeeming by such second player, in which case the first player's redemption center account will not be impacted by the game play of the first player. This redemption by such second player can happen in a variety of ways. In one method, the first player receives a reward card 810 having a reward code 820 and the first player delivers such reward card 810 to the second player, whereby the second player then accesses his/her own account at the redemption center 850 and realizes the value of the reward by inputting the reward code 820 achieved by the first player. Alternatively, the first player can designate, through the game interface or otherwise, that the value of the reward should be automatically credited to the redemption center account of the second player, and then the first player can present a reward card 810 with the reward value designated thereon to the second player as a physical manifestation of a gift that has already been realized at the second player's account. In this alternative method, a reward code 820 is not necessary as the gift by the first player has already been redeemed at the second player's account.

In the embodiment of FIG. 8, the player could also utilize the game console 800 as a redemption kiosk, whereby the player would interact directly with the redemption center 850 through the interface 830 and a redemption center portal 860 on the game 800 just like if the player were accessing the redemption center 850 from another device, such as a personal computer, mobile device or the like. Thus, for example, after the player finishes playing a game, and after the player's winnings have been credited to the player's redemption center account, the player may decide to redeem some of the value of the account for prizes redeemable through the redemption center, or for more game play, or otherwise. Similarly, the player may utilize the game console 800 as a means to replenish or add value to the player's redemption center account, whereby a player may insert money into the game 800 as a means to increase the player's credit account in the player's redemption center account instead of using the inserted money to initiate game play.

Figure 9:
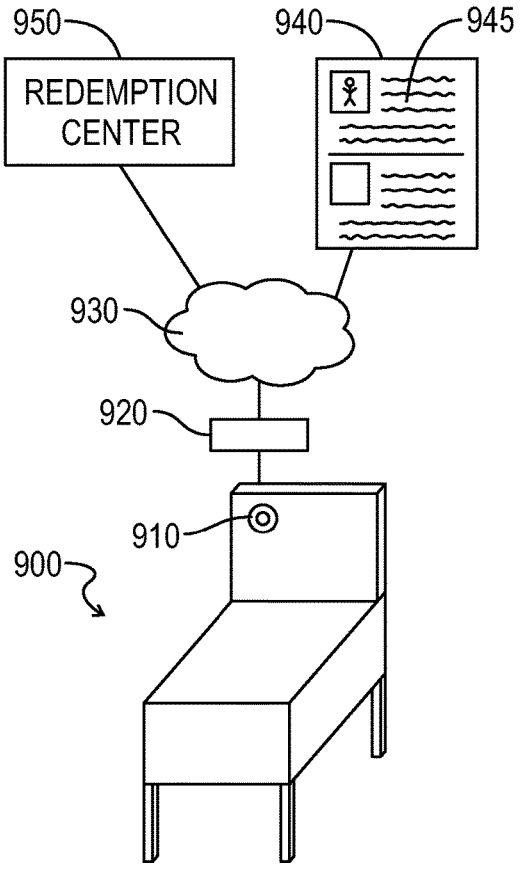

At the end of game play, the player's redemption center account will be increased by the player's winnings and the player may receive a notification, such as through electronic mail, of the result of the game play. In an alternate embodiment shown in FIG. 9, a game 900 may be equipped with a camera 910 or other information capturing device or the like that captures an image or other information about the game play and/or the player during or after game play, which image might then be communicated through a communication system 920 or the like to a network 930 to a social media website 940, such as Facebook® for example, along with a coordinated message 945 that includes information gathered by the information capturing device 910. For example, if a player achieves five hundred points by playing a game in the Hometown Bar in New York City, the social media post 945 might read something like "I just scored 500 points playing Jersey Jack Pinball's Wizard of Oz pinball machine at the Hometown Bar in New York City" followed by a link to the manufacturer of the pinball machine and a link to the website of the Hometown Bar. Or, another message might read "I just scored 500 points playing Jersey Jack Pinball's Wizard of Oz pinball machine at the Hometown Bar in New York City and I redeemed 200,000 points through the Jersey Jack Pinball Redemption Center for a new widescreen television!" followed by a link to the manufacturer of the pinball machine, a link to the website of the Hometown Bar, and a link to the Jersey Jack Pinball Redemption Center. Such published messages not only allow the player to brag to his/her friends about his/her accomplishments, but such messages also provide advertising for the game manufacturer and the game location, which incentivizes recipients of such messages to frequent the game location and/or play the same game so as to be able to similarly redeem points for prizes of their own. The publishing might also direct others to a redemption center 950 to allow others to join in the game community and take part in or track the player, etc.

In an alternate embodiment, a game is connected to a wide area network such as the Internet via a wired or wireless connection. The player initiates game play by inserting money or receiving credit through an association with the player's redemption center account. The player is then prompted to log into the player's Facebook® (or other social media) account. Once that is completed the player is then registered as being at a certain geographical location playing a certain game machine. The game machine is provided with an LCD screen or the like in the rear display with a camera that is aimed at the player. The player would be able to play the pinball machine which is a skill game, on a website where the points scored during game play would enable the player to redeem the points for prizes offered on the website. The game would take the player's picture at certain times, perhaps during a high score and the game would transmit and/or publish the picture to the player's Facebook® page and/or the player.

In an alternate embodiment, a pinball game is connected to a wide area network such as the Internet, via a wired or wireless connection, which is then associated with the player's redemption center account. The redemption center provides the player with the ability to play a video game that is completely separate from the pinball game, but that looks like a digital representation of the pinball game. So, for example, if the player was not in front of a pinball game machine, but was at home on a computer, the player could play a virtual pinball game through the redemption center like any other purely digital video game, and the player could add the value of the player's winnings to the player's redemption center account in a manner that is similar to that described above. In the present embodiment, however, the player simultaneously engages two different types of games, the first being the pinball game that the player is standing in front of, and the second being a digital representation of the pinball game on the redemption center website as viewed through a portal on a display panel of the pinball game, where the digital representation is completely controlled by the player's actions with respect to the real pinball machine. So, for example, while the player is playing the pinball game in a certain venue, such as an arcade, and while the pinball game is connected in real time to the player's redemption center account, the player experiences the game play on the play field in the game cabinet in the venue, and at the same time the game play accomplishments are being registered in real time on the player's redemption center account and such accomplishments can also be seen by the player through a digital portal on the pinball game machine that is being played by the player. If a player achieves a certain object on the play field, that object would also be achieved on the digital representation of the player's redemption center account and viewed on the digital portion displayed on the pinball machine. Furthermore, because the player's redemption center account is connected in real time to the actual pinball machine, the player's friends can follow the player online in real time by viewing the digital representation of the game play, which is identical to the actual game play, and/or through the use of a camera directed to the play field that captures a direct video feed of the play field and the game play in action. Thus, a player's friends will get to experience both a real-time version and a digital version of the game play as a result of the connection of the pinball machine through the Internet or the like. The redemption center can therefore serve as not only a portal for the particular player, but can also enable a community of players and friends to view games being played at a variety of locations at any given time. Thus, if someone want to see who is playing a game at the Hometown Bar in New York City, that person can access the redemption center site or the game manufacturer site and search for the game at the location and view the game play in real time.

In an alternative embodiment, the player could use a mobile device not only for purposes of redemption, but also to control certain aspects of the game. In one example, a user will pair a mobile device with a pinball machine through a handshake code or interaction or the like in order to create a communication link between the pinball machine and the user's mobile device. The mobile device may, for example, have an application that is downloaded from an application server that controls the communications between the pinball machine and a management server and/or redemption system portal. The mobile application may be downloaded in advance of the user playing the game, or the download may be capable of being initiated by being in spatial proximity to the pinball machine, or in response to the user scanning a code on the pinball machine that initiates the download from an application server. Thereafter, the user's mobile device is connected through a network to a management server that controls the interaction of the mobile device with the pinball machine and preferably controls the user's status with an online redemption center and/or online prize portal. The management server preferably controls several interactions with the user's mobile device and the user's interaction between the mobile device and the pinball machine including, but not limited to, keeping track of user accounts and user scores and tracking redemption of cards, points, rewards or the like. The mobile application could also automatically accumulate reward cards achievable through the game play on the mobile application and through the user's redemption center account, which could then be redeemed directly within the redemption center for prizes or the like through an online redemption or through a site-specific redemption center by a user providing the site redemption center with a code or the like from the user's mobile device. In addition, the management system also preferably allows a user to control, though the user's mobile device, certain features of the pinball machine that would only be controllable through physical interaction with the game, such as, for example with a Wizard of Oz (trademark) game, send a signal to the pinball machine that results in the spinning of Dorothy's house event, or the melting of a witch event, or the rescuing of munchkins event, or the like. Thus, a user can control the game through an interaction of the user's mobile device.

The various block diagrams in the different depicted embodiments may illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

Aspects of the invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Aspects of the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain or store the program for use by or in connection with the instruction execution system, apparatus, or device The medium is tangible, and it can be an electronic, magnetic, optical, electromagnetic, infrared, or semiconductor system (or apparatus or device). Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An arcade game redemption system comprising:

a) an arcade game including at least one achievable object in the context of a gameplay of the arcade game and at least one reward associated with the achievable object; and b) a redemption center associated with the arcade game;

c) wherein the at least one reward is awarded upon the achieving of the achievable object;

d) wherein the reward is provided in the form of a code printed on a dispensed object prior to or during the dispensing of the reward;

e) wherein the code is redeemable through the redemption center during or after gameplay;

f) wherein the achievable object is a physical interaction between a controlled game element and a target game element and wherein the at least one achievable object is a plurality of different achievable objects, and wherein the at least one reward is a plurality of different rewards associated with the plurality of different achievable objects, and wherein the code provided reflects which of the plurality of different achievable objects are achieved.

2. The arcade game redemption system of claim 1, wherein the arcade game is a pinball machine.

3. The arcade game redemption system of claim 2 wherein the achievable object is the rolling of a pinball over a target region on a playing surface of the pinball machine.

4. The arcade game redemption system of claim 2 wherein the achievable object is the directing of a pinball onto a ramp on a playing surface of the pinball machine.

5. The arcade game redemption system of claim 1, wherein the arcade game further comprises a card dispenser, and wherein the card dispenser dispenses a card containing the code to the user during or after game play.

6. The arcade game redemption system of claim 5, wherein the card dispenser further comprises a printer, and wherein the card dispenser prints the code on the card and dispenses it to the user during or after game play.

7. The arcade game redemption system of claim 6 wherein the arcade game further comprises an eraser and wherein the card may be recycled by returning the card to the arcade game through the eraser.

8. The arcade game redemption system of claim 1 wherein the redemption center is a computerized platform at which the code may be entered.

9. The arcade game redemption system of claim 8, wherein the code is invalidated after it is entered at the computerized platform and may not be reused.

10. The arcade game redemption system of claim 1, wherein the code is immediately redeemable through the redemption center via an interface associated with the arcade game.

11. A method for distributing rewards associated with an arcade game comprising:

a. providing an arcade game including at least one achievable object in the context of a gameplay of the arcade game and at least one reward associated with the achievable object;

b. issuing a code representing the at least one reward after the achievable object is achieved;

c. providing a redemption center associated with the arcade game at which the code can be redeemed;

d. receiving the code at the redemption center; and e. issuing the reward at the redemption center, wherein the achievable object is a physical interaction between a controlled game element and a target game element, and wherein the at least one reward is a plurality of different rewards associated with the plurality of different achievable objects, and wherein the code provided reflects which of the plurality of different achievable objects are achieved.

12. The method of claim 11 further comprising invalidating the code after issuing the reward.

13. The method of claim 11 further comprising printing the code on a card dispensed by the arcade game during or after game play.

14. The method of claim 11 further comprising receiving the card at the arcade game and erasing the card after issuing the reward at the redemption center.

15. The method of claim 11 wherein the redemption center is a computerized platform at which the code may be entered.

16. The method of claim 15 wherein the reward may be issued to a user account within the redemption center upon receiving the code.

17. The method of claim 11 wherein the arcade game is a pinball game.

18. The method of claim 17 wherein the achievable object the rolling of a pinball over a target region on a playing surface of the pinball game.

* * * * *